United States Patent [19]

Jeans

[11] Patent Number: 4,570,830

[45] Date of Patent: Feb. 18, 1986

[54] GRAVITY DISPENSER

[75] Inventor: Edward L. Jeans, Gwent, Wales

[73] Assignee: Cadbury Schweppes, PLC, London, United Kingdom

[21] Appl. No.: 508,559

[22] Filed: Jun. 28, 1983

[51] Int. Cl.[4] ..... B67D 3/00

[52] U.S. Cl. ..... 222/185; 222/484; 222/519

[58] Field of Search ..... 222/185, 479, 481, 482, 222/483, 484, 487, 519, 520

[56] References Cited

U.S. PATENT DOCUMENTS

| | | | |
|---|---|---|---|
| 1,368,703 | 2/1921 | Czerny | 222/185 |
| 2,036,310 | 4/1936 | Werder . | |
| 2,165,825 | 7/1939 | Von Bultzingslowen . | |
| 2,239,921 | 4/1941 | Majewski | 222/487 |
| 2,857,084 | 10/1958 | Harris | 222/481 |
| 3,991,219 | 11/1976 | Kuckens . | |
| 4,096,971 | 6/1978 | Kuckens . | |
| 4,109,829 | 8/1978 | Kuckens . | |
| 4,121,507 | 10/1978 | Kuckens . | |
| 4,378,079 | 3/1983 | Kuckens . | |
| 4,408,701 | 10/1983 | Jeans | 222/399 X |

FOREIGN PATENT DOCUMENTS

| | | |
|---|---|---|
| 1367814 | 9/1974 | United Kingdom . |
| 1514404 | 6/1978 | United Kingdom . |
| 1534361 | 12/1978 | United Kingdom . |
| 1534362 | 12/1978 | United Kingdom . |
| 2037255 | 12/1978 | United Kingdom . |
| 1537699 | 1/1979 | United Kingdom . |
| 2030962 | 8/1982 | United Kingdom . |
| 2103296 | 2/1983 | United Kingdom . |

*Primary Examiner*—F. J. Bartuska

*Attorney, Agent, or Firm*—Kenyon & Kenyon

[57] ABSTRACT

Apparatus for controlling the dispensing of a concentrate from a container at a predetermined flow rate includes a first container part a first valve part in communication with a volume of concentrate; a second part having a second mating valve part and an outlet opening therein, the second part movable with respect to the first part to selectively move the first and second valve parts with respect to each other by a preselected amount to permit flow of the concentrate from the first part, through the valve parts and out the outlet opening; cams for effecting movement of the first and second parts, the preselected amount with respect to each other; a tube to introduce air at atmospheric pressure into the container when the first and second valve parts are moved apart having a cooperating valve to prevent backflow through the tube when the first and second valve parts are in sealing relationship; and a chamber interposed between the volume of concentrate and the tube having an outlet fixed near the outlet opening, the chamber outlet being of a size which will permit a free flow of air whereby air will escape from the chamber, despite any surface tension existing in the concentrate, to replace concentrate which is dispensed through the outlet opening in such a manner so as to maintain a constant head pressure in the interior of the container.

16 Claims, 8 Drawing Figures

GRAVITY DISPENSER

BACKGROUND OF THE INVENTION

This invention relates to beverage dispensers in general, and more particularly, to an improved gravity dispenser for dispensing a concentrate to be mixed with a diluent, particularly, useful in in-home dispensers.

In my co-pending application Ser. No. 310,488, there are disclosed a number of different embodiments of concentrate dispensers. In the preferred embodiment of in-home soft drink dispenser disclosed therein, the concentrate, e.g., syrup, container is pressurized with a low pressure gas, typically the carbon dioxide used for carbonating water and is thus dispensed under a low pressure.

As disclosed therein, movement of one portion of the container relative to another opens a valve both for admitting the pressurizing gas and a valve for dispensing the concentrate. There are also disclosed a number of embodiments of gravity feed dispensers in which a constant head is maintained.

Although dispensing under pressure has advantages, it adds considerably to the cost of an in-home dispenser in that a separate regulating valve is required to reduce the carbon dioxide pressure to a few psi for use in dispensing. In addition, the manifold must contain passages for the low pressure carbon dioxide. Furthermore, when dispensing under pressure better seals are required both in the container and between the manifold and container. A further problem is the migration of $CO_2$ through the plastic container when it is being stored. This causes the container to collapse. To avoid this, containers with high barrier properties are needed. Also there is a limit to container size and shape. The size is limited because, once a certain height is exceeded, the varying head of syrup becomes significant to the flow rate of syrup from the container. Shape is restricted since one must line up both an inlet for gas and outlet for syrup.

For these reasons, it is desirable to utilize gravity dispensing so as to be able to make a product which can be sold at a reasonable low price. Of course, a gravity dispenser used in this way must reliably dispense the concentrate. The previous embodiments of gravity dispensers disclosed in the aforementioned application, although working under most conditions, were found to suffer from a number of different problems.

In particular, two conflicting requirements are present. In a device with a chamber through which air is admitted, the chamber being needed to insure a constant head under different temperature conditions, there is a requirement to have ports in the chamber to permit the egress of syrup from the container and the ingress of air to replace syrup, the air being drawn through the chamber and the syrup into the head space above the syrup. If the ports are made too small, poor flow, both air into and syrup out of the container, occurs at the low head pressure, resulting from viscosity and surface tension effects. With small gas inlet orifices, the surface tension effects of the syrup may be high enough to prevent air bubbles formed within the syrup at the orifice from disengaging reliably from it thereby leading to erratic performance. However, the problem on the other hand, is that, with large openings, it becomes possible, when the concentrate container is removed and tilted or turned upside down, for the chamber to fill with syrup. If the chamber fills with syrup, syrup can surround or get into the air inlet tube through which air is admitted and can leak back or, more significantly, can lead to the formation of an air bubble at the top of the air inlet tube which prevents venting because of the same problems with viscous syrups and surface tension.

Thus, for a gravity dispenser to be reliable and useful in this setting, it must overcome these problems.

SUMMARY OF THE INVENTION

In general, these problems are solved by providing means which will permit air to enter into the container but will at the same time prevent a backflow of fluid into the air inlet and which means will also permit free access of the syrup to the outlet valve at the time of dispensing. In general terms, this is accomplished by using a chamber, with the chamber mounted such as to allow the free access of syrup to the outlet valve at the time of dispensing. The chamber has an inlet for air situated such that there is little likelihood of backflow and an outlet from the chamber which is of sufficient size to overcome surface tension and viscosity problems to permit air to reach the inside of the container. The air outlet from the chamber must be fixed near the point of outflow so as to maintain the desired constant head in the container.

Stated another way, the present invention overcomes these problems with a gravity dispensing arrangement which operates reliably by providing a chamber inside the neck of the bottle into which air at atmospheric pressure is admitted. The chamber contains large ports to avoid problems with the egress of syrup under different temperature conditions, while still permitting the ingress of air into the main part of the container. The problem of filling the chamber with syrup and permitting it to get into the dip tube and cause leakage and other problems is avoided through the use of a baffle at the mouth of the chamber which insures that no matter which way the container is tilted a certain amount of air will remain within the chamber so that when inverted and placed on the dispenser, the dip tube will be free of syrup.

Through the use of a gravity dispenser, a low pressure regulator in the system is avoided. The number of passages which are necessary in the manifold is reduced as are the various seals in the manifold. Furthermore, because there is no need to bring a gas supply to the container, the dispensing of water is simplified and can be, for example, an annular flow around the syrup. Furthermore, because of the low pressures involved, it is believed that O-ring seals within the container can be eliminated and simple plastic seals utilized. In addition, the container can be any size and shape and can be made of a cheaper plastic material since high barrier properties are not needed to avoid the problem with carbon dioxide migration. All of this is accomplished while still reliably dispensing at a constant head pressure and avoiding the problems which existed in prior art gravity dispensers.

Although the flow control apparatus of the present invention is shown in the illustrated embodiments, directly at the container neck, other emobidment where the valving, chamber etc. are remote from the container per se are possible.

DETAILED DESCRIPTION

Figure 1:
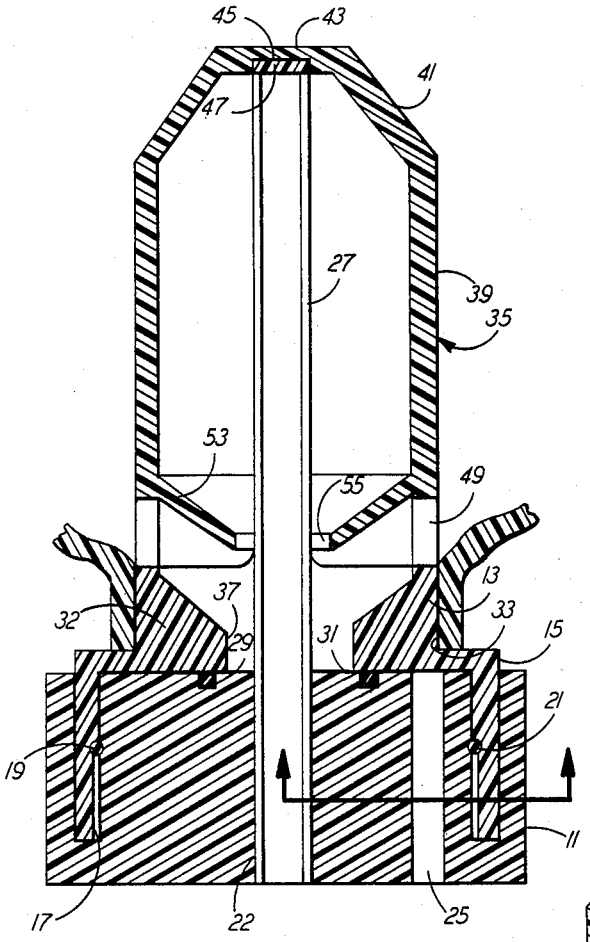
FIG. 1 is a cross-sectional view of a first embodiment of the present invention.

The arrangement of the present invention is quite similar to that disclosed in connection with FIG. 31, for admitting a gas under pressure, in my aforementioned application Ser. No. 310,488. As illustrated by the cross-section view of FIG. 1, there is a part 11 in the nature of a cap and a part 13 which is an insert into the bottle. The insert 13 has a cylindrical portion 15 which, in effect, forms an extension of the neck of the bottle on which the cap 11 is mounted, the cap 11 containing an annular recess 17 into which the cylindrical portion 15 fits. On the inner surface of the cylindrical portion 15 a step 19 is formed which cooperates with an O-ring 21 to seal parts 13 and 11. The part 11 is of essentially cylindrical shape with the annular recess 17 containing a central bore 23 and an offset opening 25, the opening 25 being the dispensing passage for the concentrate through the cap part 11. As in the aforementioned application, this opening is sized to meter the flow depending on the viscosity of the particular concentrate to be dispensed. A tube 27 extends from the bore 23. The tube 27 may be molded integrally with part 11 or may be a separate tube sealed to it. Also formed at the inside of the cap part 11 is an annular recess 29 for receiving an O-ring 31.

Adjacent to cylindrical part 15 is a cylindrical part 33 of reduced diameter which may be press fitted into the neck of the container. Mounted on the part 33 is a generally cylindrical chamber 35 forming an air chamber for venting to the atmosphere and maintaining a constant head pressure in a manner described in my aforementioned patent application. A central bore 37 is formed in the parts 13 and 33 through which the tube 27 may extend. The chamber 35 has a generally cylindrical side wall 39, a truncated conical portion 41 and a flat top 43. On the inside of the top a recess 45 is formed in which there is inserted a gasket 47 against which the tube 27 seals when the cap 11 is turned to a closed position on the part 13. This is accomplished using the type of camming arrangement disclosed in my aforementioned copending application. The O-ring 31, in the closed condition of the valve, seals against the outer surface 32 of the insert part 13 to prevent flow into the outlet port 25.

In accordance with the present invention, there are formed, in the side walls 39, ports 49. Preferably, there will be three ports spaced 120 degrees apart.

Figure 2:
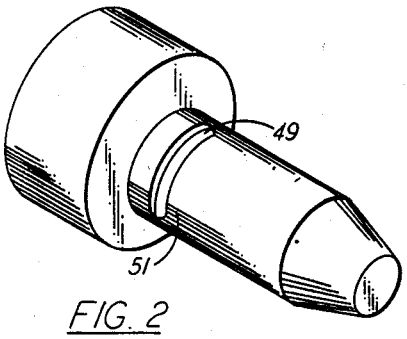
FIG. 2 is a perspective view of a portion of the embodiment of FIG. 1.

As illustrated by the perspective view of FIG. 2, the ports 49 are elongated with rounded ends. Preferably, the ports take up most of the circumference of the wall 39 so that, in effect, the wall 39 stands only on three small legs 51. Furthermore, in accordance with the present invention, there is a conical baffle 53 with a central opening 55 through which tube 27 may pass; it is this baffle 53 which insures that the chamber 35 cannot be filled with liquid to prevent operation no matter how the container is turned. Baffle 53 sealingly engages with wall 39 to form a chamber 35. Because of the baffle and also because of the truncated conical portion 41, no matter which way the container is turned, when it is put back in the operating position, there is a sufficient amount of air remaining within the chamber 35 to insure that the top of tube 27 is not immersed in concentrate. This, in addition to the large size of the ports 49, these ports typically having a width of 0.225 inches and a length of 0.605 inches, insures operation under all conditions.

Figure 3:
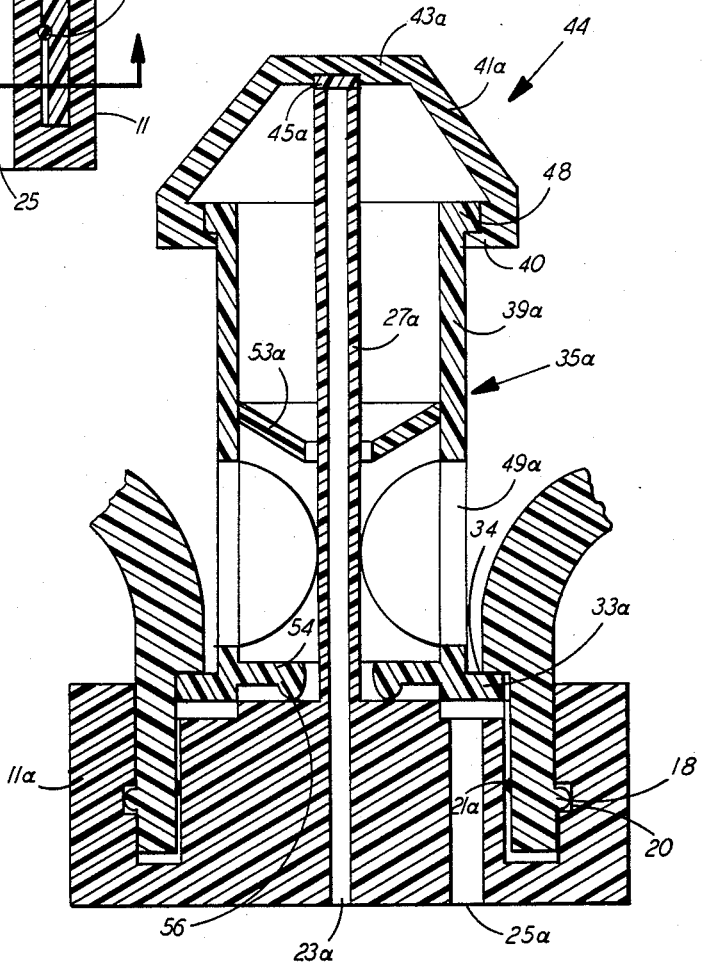
FIG. 3 is a cross-sectional view of an alternate embodiment.

FIG. 3 illustrates an alternate embodiment of the present invention which eliminates the O-ring seals of FIG. 1. Parts which perform the same function are given the same number followed by the letter "a."Construction in FIG. 3 is adapted to be an all molded construction and to minimize the amount of assembly. As illustrated, the cap 11*a* has molded integrally with it, the tube 27*a*. The cap is essentially as before except that the part 15 which fits into the annular opening in the cap is part of the container and not a separate insert. This then simplifies construction. Also shown is a projection 18 fitting into a slot 20 on each side. These are used to cause a relative movement of the cap with respect to the container to permit dispensing in the manner discussed, in detail, in my aforementioned patent application. The container is molded with a lip 21*a* to insure sealing against the recess 17*a* in the cap to take the place of the O-ring seal. The chamber 35*a* is made of two parts, it includes a cylindrical part 39*a* which has molded into it the baffle 53*a*. The cap 11*a* has molded into it an annular seal 54 which seals against the inside bore of cylndrical part 39*a* avoiding the O-ring seal at that point. The cylindrical part 35*a* has a flange 33*a* which press fits into a suitable recess 34 formed in the neck 15*a* of the container. Snapped over the top of the cylindrical part and retained in place by a flange is a part 44 which includes the truncated conical portion 41*a* and top 43*a*. This part 44 is provided with a flange 46 which snaps around and sealingly engages with a flange 48 on the top of the cylindrical part 39*a*. Through this construction, it is possible to mold the part 39*a* in a single molding operation. As in the previous embodiment, there are the cutouts 49*a* to permit the ingress of syrup and the egress of air.

Figure 4:
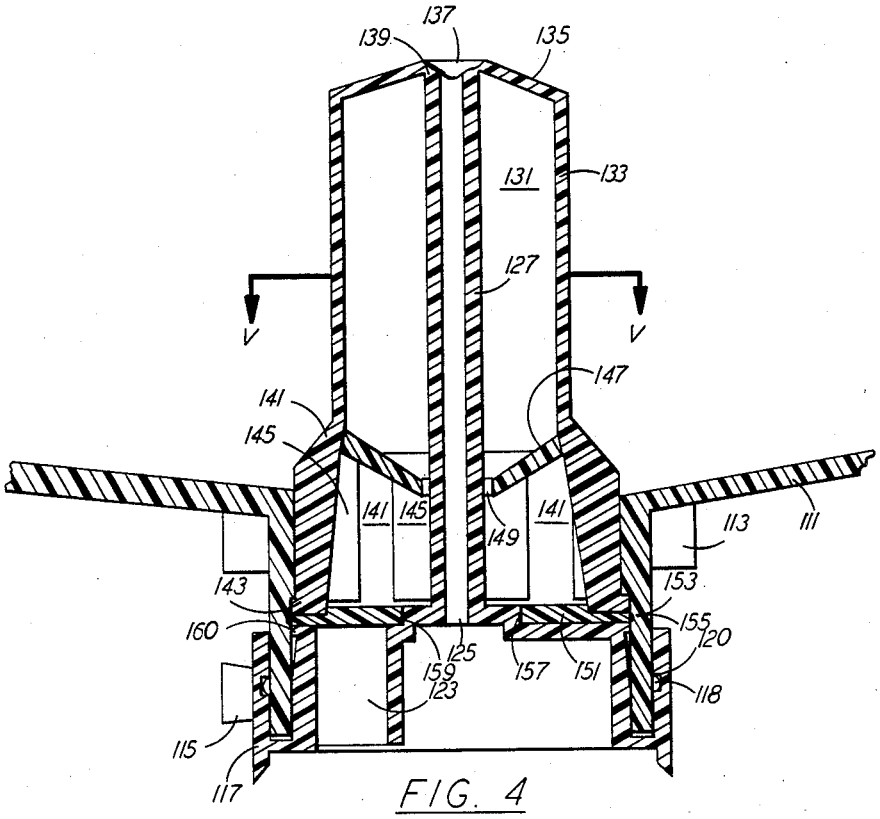
FIG. 4 is a cross-sectional view through a further embodiment of a dispenser according to the present invention.

FIG. 4 is an embodiment which is particularly simple to manufacture. Shown, is a portion of the bottle 111 having tabs 113 which fit in appropriate slots in a dispensing valve as described in the aforementioned application, Ser. No. 310,488. These tabs and a tab 115 on a cap portion 117 cooperate to achieve relative rotation of the cap and bottle. The cap contains slanted slots 29 into which projections 18 on the neck of the bottle 111 fit to achieve the relative movement of the cap with respect to the container to permit dispensing. In the illustrated embodiment, cap 117 is provided with an outlet opening 123. The cap also has an air inlet 125 leading into a tubular projection 127. The tubular projection or tube 127 extends into a chamber 131 having an essentially cylindrical side wall 133 and a top wall 135 with a partially conical shape. The center portion 137 of the top wall is flat on the outside and contains a sealing projection 139 on the inside which locates and seals against the inner diameter of the tube 127 when the cap is in the position shown. Rotation of the cap on the neck of the bottle 111 will result in the tube moving away from the projection 139 to permit air to flow into the chamber 131.

Figure 5:
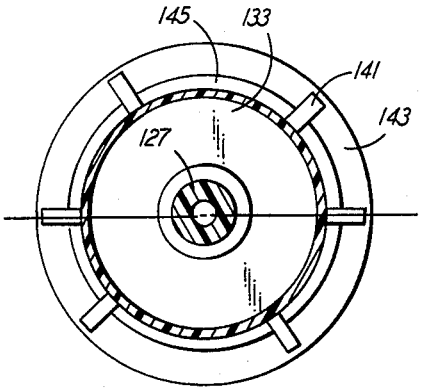
FIG. 5 is a cross section V—V through the embodiment of FIG. 4.
Figure 6:
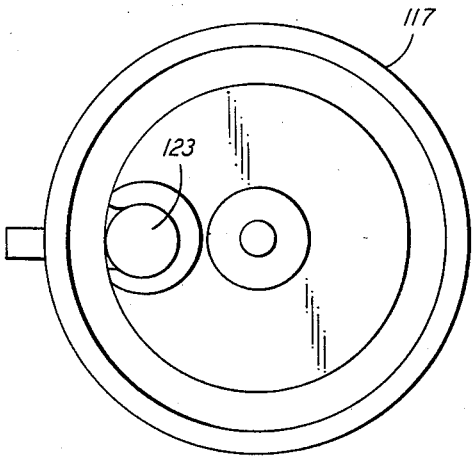
FIG. 6 is a bottom plan view of the embodiment of FIG. 4.

The chamber side wall 133 is supported on a plurality of struts 141, which in turn are supported in an annular flange member 143 which is press fitted into the neck of the container 111. As is particularly visible with reference to FIG. 5, there are relatively large gaps 145 between the struts 141. This permits a free flow of air out into the container without viscosity or surface tension becoming a problem. As with the previous embodiments, to prevent an undesired accumulation of syrup in the chamber 131, a baffle 147, which snaps into grooves formed at the inside of the side wall 133, is provided. It has a circular opening 149 at its center to permit flow of air out through the openings 145.

Directly below the flange 143 is a sealing disc 151 which has projections 153 at its circumference which snap into a groove 155 in the neck of the container 111. The sealing disc 151 has an inner central opening 157 into which a step portion 159 on the cap fits sealingly at this point. This prevents any outflow of syrup through the outlet 123 when in the closed position. The snapping in place of the sealing disc makes a seal at its circumference preventing leakage at that point. With the exception of the cap, the remaining parts of the chamber are preferably made of high density polyethylene with the cap of low density polyethylene. This then permits a good seal between the projection 139 and tube 127 and between the step portion 159 and the sealing disc 151 at the opening 157 since one is of the softer and the other of a harder material. To prevent leakage during operation when step portion 157 is separated from disc 151 and concentrate is flowing out of outlet 123, an annular seal is formed in cap portion 117.

It has also been discovered that in operation under certain conditions resulting from temperature variations there is a surge problem and a certain amount of syrup will tend to surge into the chamber when the outlet is opened. If this surge was sufficient to permit syrup to reach the top of the tube 127, a problem of a bubble forming at that point could exist. It has been found that, with a 500 milliliter container making the chamber of a capacity of about 10–20 milliliter avoids this problem.

Figure 7:
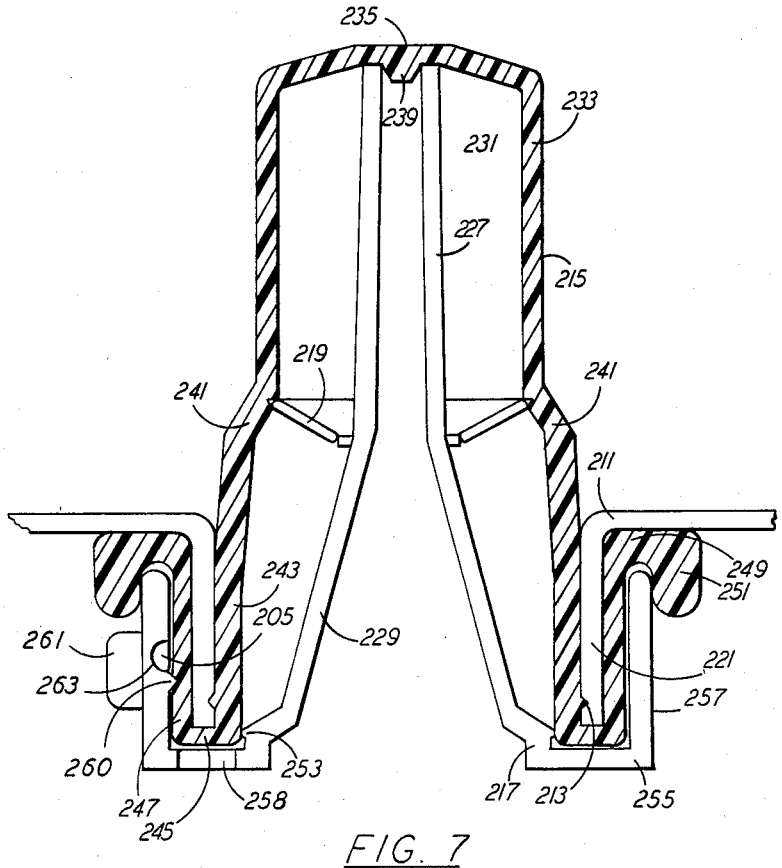
FIG. 7 is a cross-sectional view of a further embodiment which provides a simple molding.

FIG. 7 illustrates a further embodiment according to the present invention. In this embodiment, which is particularly adapted for fitting onto the neck of a container on an automatic assembly line, the container 211 has a simple cylindrical neck with an annular groove 213. A three-part assembly comprising, in general, a chamber part 215, a cap part 217 and a baffle 219 snaps onto the neck 221 of the container 211. The chamber part 215 is generally as described in connection with FIG. 4 in terms of a chamber 231 with side walls 233 and top wall 235 with an inner projection 239. Once again, the baffle 219 snaps into a groove on the inside of the side wall 233. Once again, struts 241 support the chamber. However, in this case the strut rather than terminating in a flange continues into a solid cylindrical portion 243 of U-shaped construction having a base portion 245 and another cylindrical portion 247 which snaps onto the neck 221 of the bottle. The part 247 has enlarged outwardly extending lugs 251 at opposite sides forming the same function as tabs 113 of FIG. 5.

The cap portion includes tube 227 opening into a wider conical portion 229 which extends to the outer end of the cap. At the point where this meets the the outer end, a sealing surface 253 is formed sealing against the inside of the part 243. The cap has a flat, annular top 255 with the outlet opening 258 in this top part. The side wall 257 of the cap surrounds part 247 with an integrally molded seal 260 to prevent flow of concentrate between the two parts. A tab 261 is formed on the cap. As in the previous embodiment, there is a cooperating groove 263 and tab 265 to obtain relative movement between the cap and the remainder of the structure.

As noted above, this embodiment is particularly simple in terms of molding and in terms of insertion onto the neck of a bottle which needs no special molding, i.e., it does not need separately molded tabs since these are formed by the insert, nor does it have to be molded with projections which cooperate with a cap to obtain relative motion. In addition, since the length of the outlet passage 257 is shorter, improved starting and stopping of the flow without delay becomes possible and the possibility of syrup remaining in the outlet opening is considerably reduced.

Figure 8:
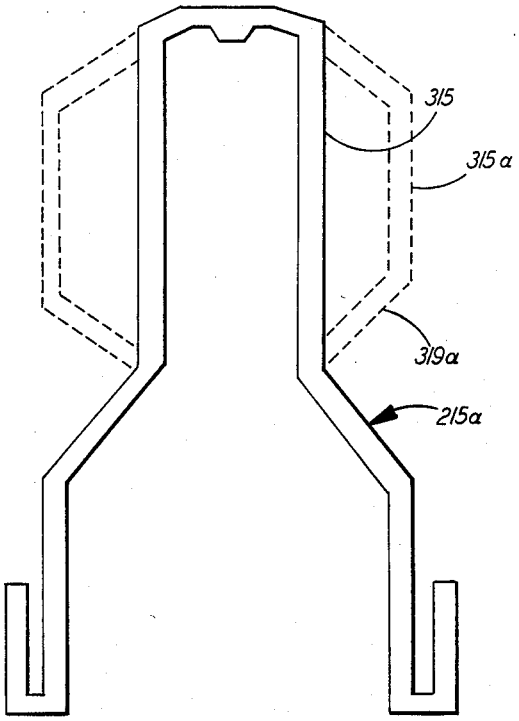
FIG. 8 is a view of a further embodiment similar to FIG. 7, which is molded of a single piece.

FIG. 8 illustrates an even simpler manner of making a part 215*a* corresponding to the part 215 of FIG. 7. Here, the part 315 shown in solid lines is first molded and then, through blow molding is caused to take the shape 315*a* shown in dotted lines, thereby integrally forming the baffle 319*a*. Used with the cap part of FIG. 7, this results in a simple two part insert to the bottle which performs the function of outlet valve and air inlet.

Tests with the gravity dispenser of the present invention have been successfully conducted under varying conditions and have provided repeatability and high quality in the drinks that have been produced.

What is claimed is:

1. Flow control apparatus for use with a closed container, for controlling the dispensing of a concentrate at a predetermined flow rate comprising:

(a) a first part, terminating in a first valve part and adapted to be placed in communication with a volume of concentrate contained within the container;

(b) a second, cap-like member surrounding said first part and having a second mating valve part therein and having means forming an outlet opening, said cap-like member movable with respect to said first part to selectively move said first and second valve parts with respect to each other by a preselected amount to permit flow of said concentrate from said first part through said valve parts and out through said outlet opening;

(c) an opening through said cap-like memb er extending as a tube into said first part for introducing air at atmospheric pressure into the container;

(d) means forming a chamber supported at said first part, said chamber interposed between the volume of concentrate and said tube, said chamber having a chamber outlet fixed near said outlet opening and a top inwardly spaced from said outlet opening, said chamber outlet being a size which will permit a free flow of air, whereby air will escape from said chamber, despite any property of said concentrate, to replace concentrate which is dispensed through said outlet opening in such a manner so as to maintain a constant head pressure in the interior of said container;

(e) a valve for controlling flow through said tube comprising a first valve member at the top of said chamber and a second valve member on said tube cooperating with said first valve member to block flow through said tube when said first and second valve parts are in sealing relationship;

(f) means for effecting relative movement of said cap-like member with respect to said first part to cause movement of said first and second valve parts with respect to each other, comprising cooperating surfaces on said first part and said cap-like member for converting a relative rotation between said first part and cap-like member into a linear movement between said cap-like member and said first part; and (g) means to prevent backflow of concentrate through said chamber and to said air inlet.

2. Apparatus according to claim 1, wherein said first part is cylindrical and said chamber comprises a cylindrical member.

3. Apparatus according to claim 2 and further including an O-ring seal between said first and second valve parts to stop flow to the outlet opening in said cap when said valve is closed.

4. Apparatus according to claim 2, wherein said chamber comprises a first cylindrical member which is inserted into said first part and a second member comprising a truncated member with a flat top, said first and second members interlocking to form an overall chamber.

5. Apparatus according to claim 6, wherein said first valve member comprises a resilient valve seat at the top of said chamber and said second valve member comprises a flat end on said tube.

6. Apparatus according to claim 5, wherein said chamber has an inner portion comprising a truncated conical section with a flat top, and said valve seat disposed inside said flat top.

7. Apparatus according to claim 1, wherein said first valve member comprises a projection at the top of said chamber and said second valve member comprises the inner circumference of said tube.

8. Apparatus according to claim 1 wherein said means for preventing backflow of concentrate comprises an annular baffle extending inwardly from the inside of said chamber surrounding said tube with a spacing, said baffle disposed between the end of said tube and said enlarged opening in said chamber.

9. Apparatus according to claim 8, wherein said baffle extends inwardly and downwardly.

10. Apparatus according to claim 1 and further including means for establishing a seal between said first part and said cap-like member to prevent leakage when the valve is opened.

11. Apparatus according to claim 1, wherein said first valve part comprises a plastic surface integrally molded into said chamber and wherein said second valve part comprises a surface of said cap-like member.

12. Apparatus according to claim 11, wherein said chamber comprises a first molded part having an inner end which is cup-shaped, formed by cylindrical side wall and an inner wall; a plurality of struts on which said cup-like portion is supported; a cylindrical portion terminating in a part of U-shaped cross section supporting said struts, said U-shaped cross section forming an annular cylindrical recess into which said first part is inserted and wherein said caplike member comprises a cap inserted over said U-shaped portion having an annular base portion cooperating with the base of said U and forming a seal therewith, the outlet opening formed in said annular portion, whereby said cap and said U-shaped portion form said first and second valve parts.

13. Apparatus according to claim 1, wherein said outlet opening is sized so as to establish a controlled rate of flow.

14. Apparatus according to claim 13 and in combination with container terminating in a neck, said neck forming said first part.

15. Flow control apparatus for use with a closed container, for controlling the dispensing of a concentrate at a predetermined flow rate comprising:

(a) a first part, terminating in a first valve part and adapted to be placed in communication with a volume of concentrate contained within the container;

(b) a second, cap-like member surrounding said first part and having a second mating valve part therein and having means forming an outlet opening, said cap-like member movable with respect to said first part to selectively move said first and second valve parts with respect to each other by a preselected amount to permit flow of said concentrate from said first part through said valve parts and out through said outlet opening;

(c) an opening through said cap-like member extending as a tube into said first part for introducing air at atmospheric pressure into the container;

(d) means forming a chamber supported at said first part, said chamber interposed between the volume of concentrate and said tube, said chamber having a chamber outlet fixed near said outlet opening and a top inwardly spaced from said outlet opening, said chamber outlet being a size which will permit a free flow of air, whereby air will escape from said chamber, despite any property of said concentrate, to replace concentrate which is dispensed through said outlet opening in such a manner so as to maintain a constant head pressure in the interior of said container, comprising:

(i) a sealing disc forming the base of said chamber inserted into and retained within a groove on the inner diameter of said first part and having a central opening therein, said tube extending through said central opening, said cap-like member have a step portion surrounding said tube cooperating with said opening and sealing thereagainst to prevent flow from said chamber to said outlet opening;

(ii) an inner cylindrical portion comprising a cylindrical cup-like portion having side walls, an inner portion, and a plurality of struts supporting said cup-like portion;

(iii) an annular flange joining said struts and seated on said sealing disc;

(iv) and a baffle inserted in said chamber at the bottom of said cup-shaped part;

(e) a valve for controlling flow through said tube;

(f) means for effecting relative movement of said cap-like member with respect to said first part to cause movement of said first and second valve parts with respect to each other; and (g) means to prevent backflow of concentrate through said chamber and to said air inlet.

16. Apparatus according to claim 15, wherein said valve for controlling flow through said tube comprises a first valve member at the top of said chamber and second valve member on said tube cooperating with said first valve member to block flow through said tube when said first and second valve parts are in sealing relationship and further including means for effecting movement of said valve parts comprising cooperating surfaces on said first part and said cap-like member for converting a relative rotation between said first part and cap-like member into a linear relative movement between said cap-like member and said first part.

* * * * *

UNITED STATES PATENT AND TRADEMARK OFFICE

CERTIFICATE OF CORRECTION

PATENT NO. : 4,570,830

DATED : 18 February 1986

INVENTOR(S) : Edward L. JEANS

It is certified that error appears in the above-identified patent and that said Letters Patent is hereby corrected as shown below:

Column 7, line 1 of claim 5: change "6" to --1--.

Signed and Sealed this

First Day of November, 1988

*Attest:*

DONALD J. QUIGG

*Attesting Officer*

*Commissioner of Patents and Trademarks*